US007086385B2

(12) United States Patent
Imoehl

(10) Patent No.: US 7,086,385 B2
(45) Date of Patent: Aug. 8, 2006

(54) UNITARY FUEL INJECTOR MODULE FOR FUEL SYSTEM

(75) Inventor: William J. Imoehl, Williamsburg, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/891,502

(22) Filed: Jul. 15, 2004

(65) Prior Publication Data

US 2006/0011171 A1 Jan. 19, 2006

(51) Int. Cl.
*F02M 37/04* (2006.01)

(52) U.S. Cl. ..... 123/470; 439/130

(58) Field of Classification Search ..... 123/456, 123/470, 408, 469, 472; 439/130, 74, 652, 439/654, 214–216, 606, 678, 639, 207, 209, 439/211

See application file for complete search history.

(56) References Cited

U.S. PATENT DOCUMENTS

| | | | | |
|---|---|---|---|---|
| 4,307,693 | A | 12/1981 | Glöckler et al. | |
| 4,776,313 | A | 10/1988 | Freismuth et al. | |
| 4,857,003 | A * | 8/1989 | Hafner et al. | 439/130 |
| 4,909,221 | A | 3/1990 | Heuser | |
| 5,030,116 | A * | 7/1991 | Sakai et al. | 439/130 |
| 5,168,857 | A | 12/1992 | Hickey | |
| 5,189,782 | A | 3/1993 | Hickey | |
| 5,465,699 | A | 11/1995 | Voigt | |
| 5,568,798 | A | 10/1996 | Lorraine | |
| 5,584,704 | A * | 12/1996 | Romann et al. | 439/130 |
| 5,657,733 | A | 8/1997 | Dozier et al. | |
| 5,680,845 | A | 10/1997 | Peng | |
| 5,682,859 | A | 11/1997 | Wakeman | |
| 5,718,206 | A * | 2/1998 | Sawada et al. | 123/470 |
| 5,743,235 | A | 4/1998 | Lueder | |
| 5,934,252 | A * | 8/1999 | Hafner et al. | 123/468 |
| 6,260,537 | B1 | 7/2001 | Lamb et al. | |
| 6,308,686 | B1 | 10/2001 | Mammarella et al. | |
| 6,748,926 | B1 * | 6/2004 | Lee et al. | 123/470 |
| 6,758,192 | B1 * | 7/2004 | Vanderveen et al. | 123/456 |
| 6,886,538 | B1 * | 5/2005 | Lee et al. | 123/470 |
| 2003/0230283 | A1 * | 12/2003 | Vanderveen et al. | 123/456 |

FOREIGN PATENT DOCUMENTS

| | | |
|---|---|---|
| EP | 0 430 525 A2 | 6/1991 |

* cited by examiner

*Primary Examiner*—Carl S. Miller

(57) ABSTRACT

A power module for a fuel injection unit is shown and described. The power module includes a housing that has a plurality of first and second housing portions spaced apart along a first axis. Each of the first housing portions is formed to enclose each of a plurality electromagnetic coil subassemblies spaced apart along the first axis. Each of the second housing portions connects the plurality of first housing portions together along the first axis and includes a wall with at least one inflection portion with respect to the first axis. A fuel injector module is also shown and described. The fuel injector module includes the power module and a plurality of valve group subassemblies. Each of the valve group subassemblies is disposed in respective first housing portions of the module and secured thereto via a securement. Various methods relating to the power module and fuel injector module are described.

17 Claims, 5 Drawing Sheets

UNITARY FUEL INJECTOR MODULE FOR FUEL SYSTEM

BACKGROUND OF THE INVENTION

It is believed that in the conventional fuel injection system can be assembled, in part, by mounting an air intake manifold to the intake ports of an engine, inserting the outlet of a fuel injector to an injector boss formed in the intake manifold, and coupling a fuel rail cup to the fuel injector inlet.

The assembly of the conventional fuel system above is believed to require additional operations. In particular, it is believed that where the engine requires a plurality of fuel injectors, each injector must be inserted individually into a fuel injection port. Where the dimensional tolerance between the spacing of the fuel injection ports relative to the spacing of the fuel rail cups exceeds permissible cumulative tolerance, misalignments, and therefore difficulty in assembly and even leaks may result. To alleviate for misalignments, additional remedial operations to provide for components within permissible cumulative tolerance may be required. Furthermore, even if there were no misalignment during assembly, thermal expansion of the fuel rails or fuel injection ports may cause misalignments between the fuel rail cups and the fuel injection port in which each fuel injector is mounted therebetween.

SUMMARY OF THE INVENTION

The present invention provides a power module for a fuel injection unit. The power module comprises a housing. The housing can include a plurality of first and second housing portions spaced apart along a first axis. Each of the first housing portions is formed to enclose each of a plurality electromagnetic coil subassemblies spaced apart along the first axis. Each of the second housing portions connects the plurality of first housing portions together along the first axis and includes a wall with at least one inflection portion with respect to the first axis.

In yet another aspect of the invention, a fuel injector module is provided. The fuel injector module comprises a housing and a plurality of valve group subassemblies. The housing can include a plurality of first and second housing portions spaced apart along a first axis. Each of the first housing portions is formed to enclose each of a plurality electromagnetic coil subassemblies spaced apart along the first axis. Each of the second housing portions connects the plurality of first housing portions together along the first axis and includes a wall with at least one inflection portion with respect to the first axis. Each of the valve group subassemblies is disposed in each of the plurality of first housing portions and connected to the first housing portion via a securement.

In yet another aspect of the invention, a method of forming a power module is provided. The power module includes a plurality electromagnetic coil subassemblies spaced apart along an axis. The method can be achieved by providing conductive members extending oblique to the axis between each of the electromagnetic coil subassemblies, the conductive members terminating at a common terminus; and molding a housing about each of the plurality of electromagnetic coil subassemblies and conductive members to form a unitary power module.

In yet a further aspect of the invention, a method of assembling a fuel injector module to an engine and a fuel rail is provided. The engine includes a plurality of fuel injection ports. Each fuel injection port extends along a port axis. The fuel rail includes a plurality of spaced apart fuel rail cups. The fuel injector module includes a unitary power unit and a plurality of valve group subassemblies disposed in the unitary power unit. Each of the valve group subassemblies can include inlet and outlet ends disposed along a longitudinal axis. The method can be achieved by inserting the outlet end of each valve group subassembly into each fuel injection port; fitting and the inlet end of each valve group subassembly into each fuel rail cup; and compensating for misalignments between (a) the outlet of each valve group subassembly with each fuel injection port, and (b) the inlet end of each valve group subassembly with each fuel rail cup.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1A:
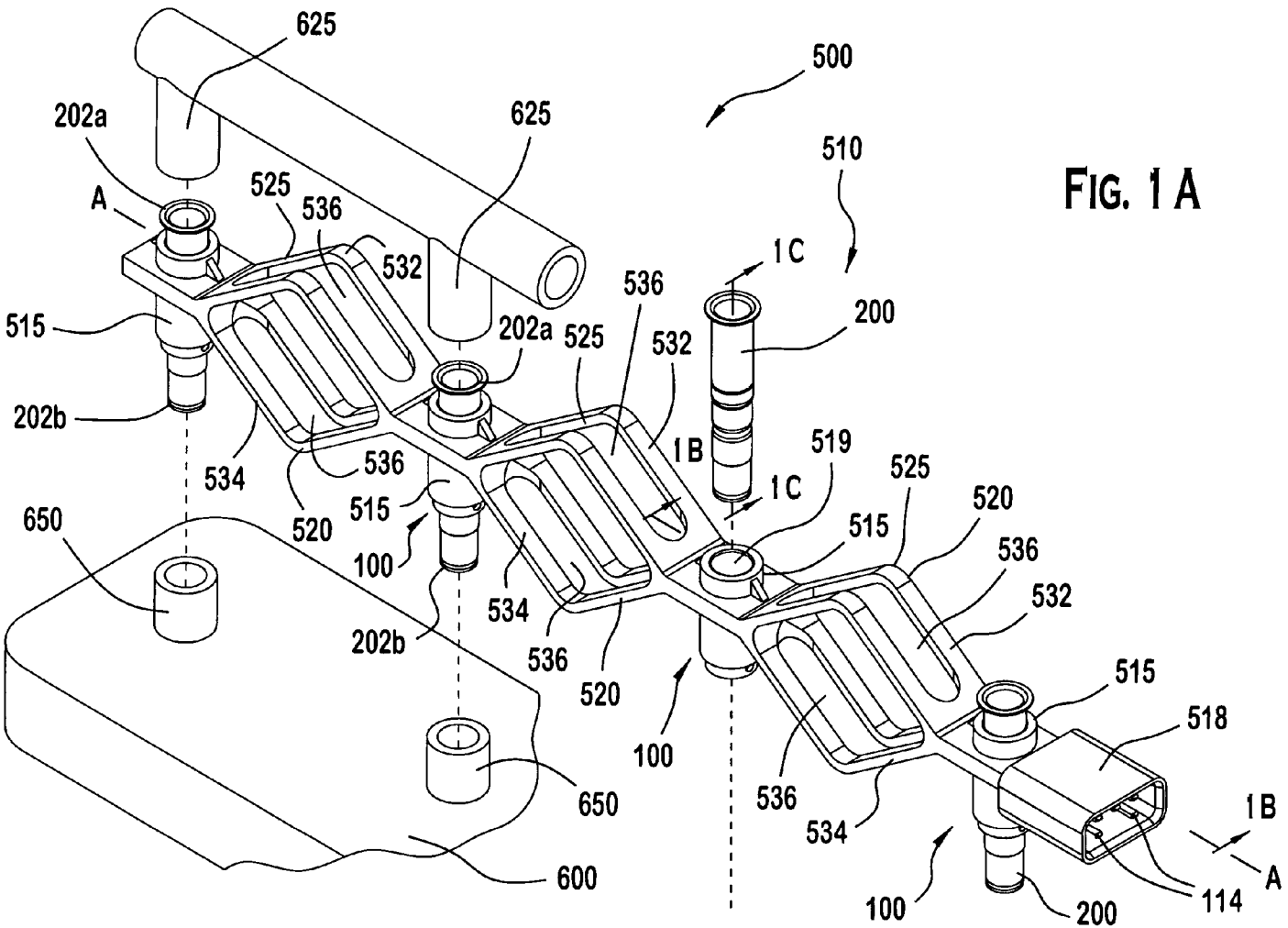
FIG. 1A illustrates a perspective view of a first preferred embodiment of the unitary power module with valve group subassemblies.
Figure 1B:
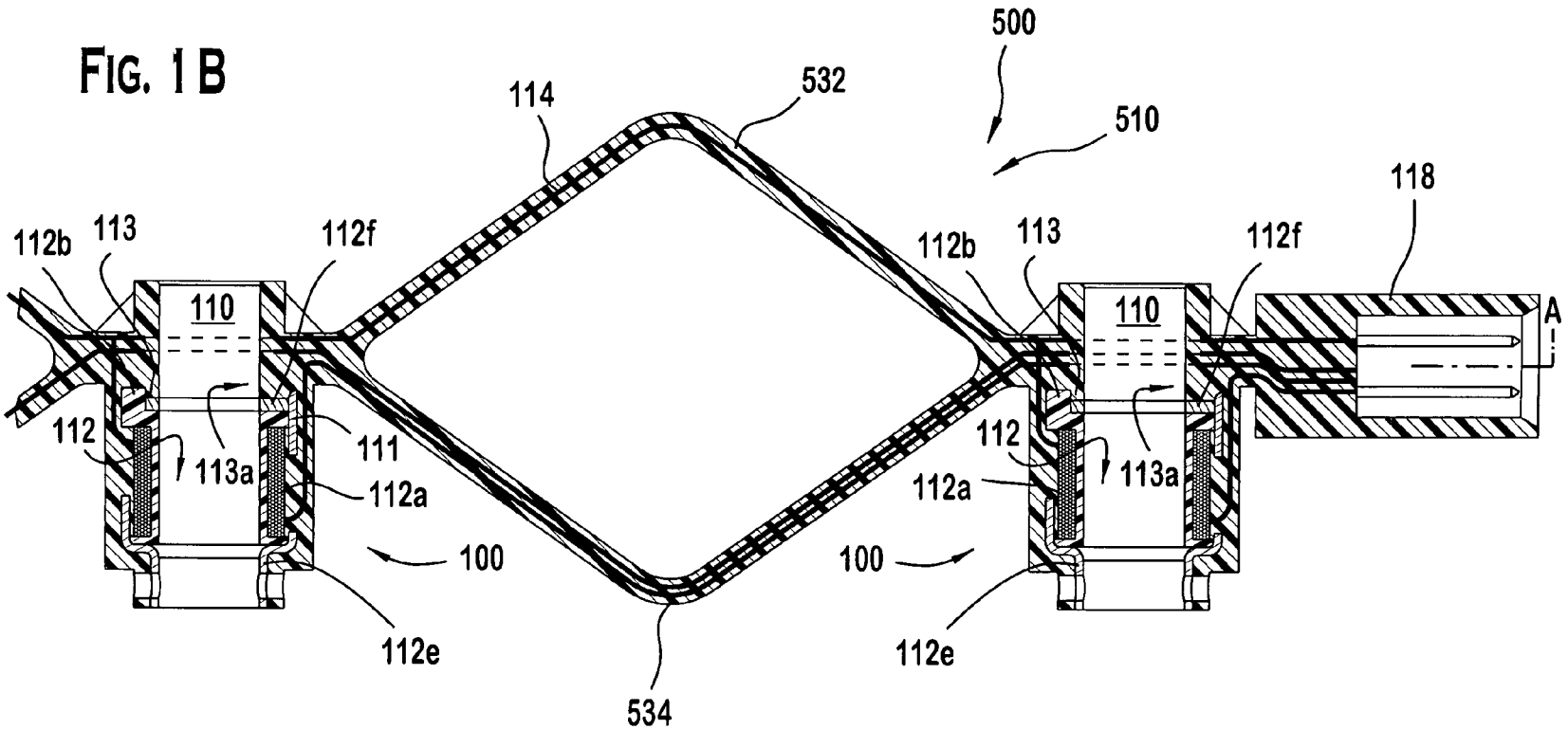
FIG. 1B illustrates a cross-sectional view of the unitary power module of FIG. 1A.
Figure 1C:
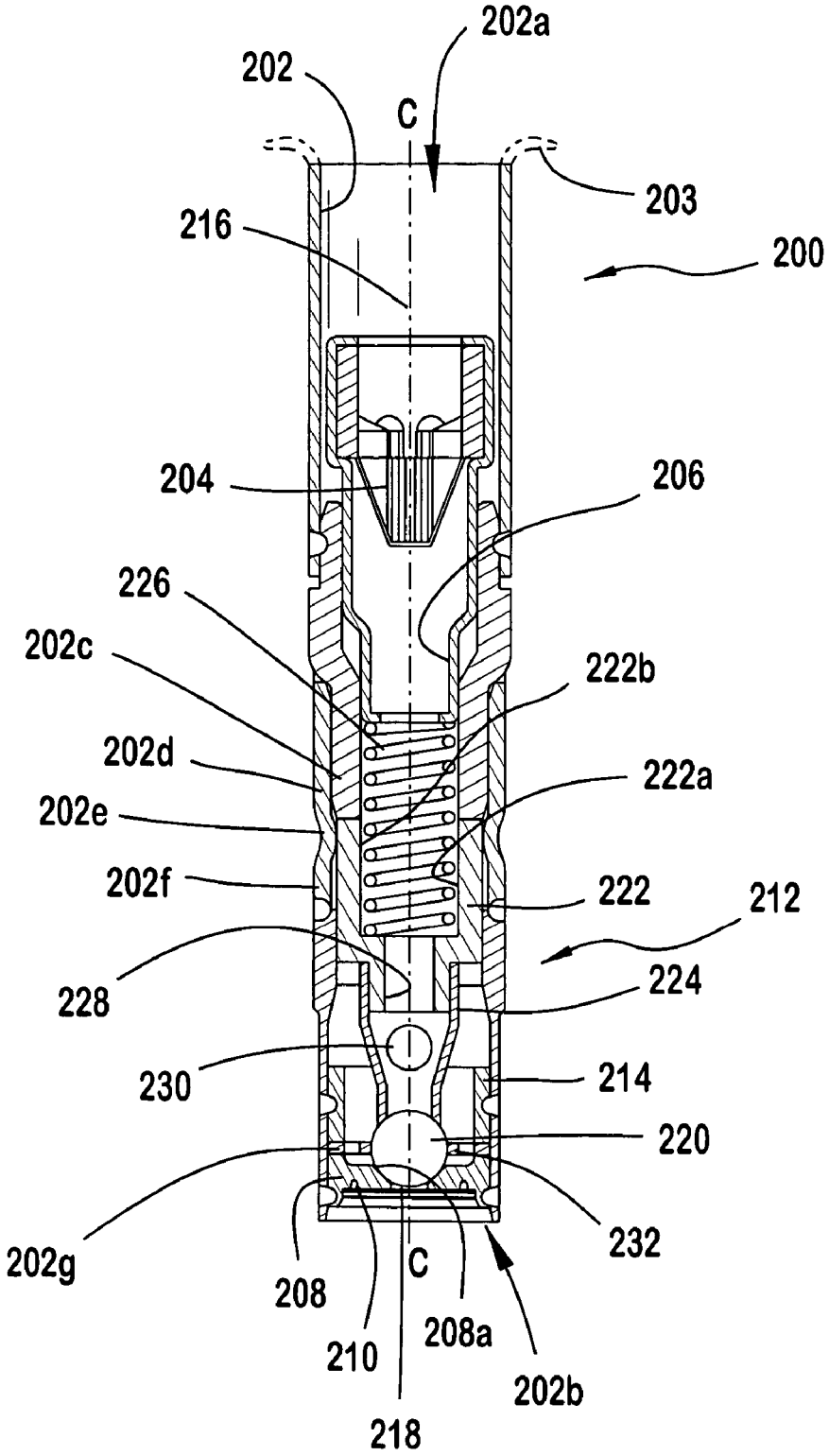
FIG. 1C illustrates a cross-sectional view of a valve group subassembly according to a preferred embodiment that can be used with the power module of FIG. 1B.
Figure 2A:
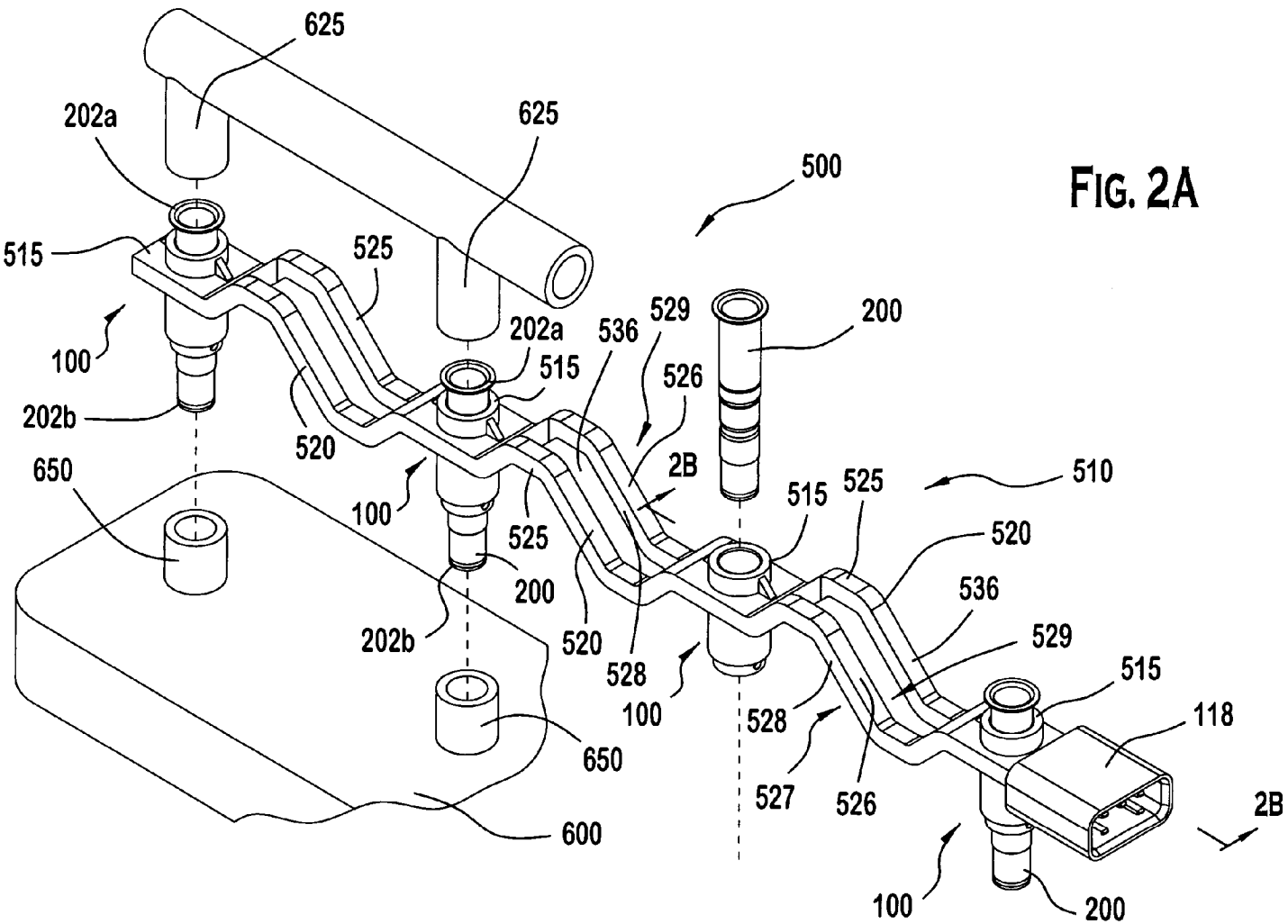
FIG. 2A illustrates a perspective view of a second preferred embodiment of the unitary power module with valve group subassemblies.
Figure 2B:
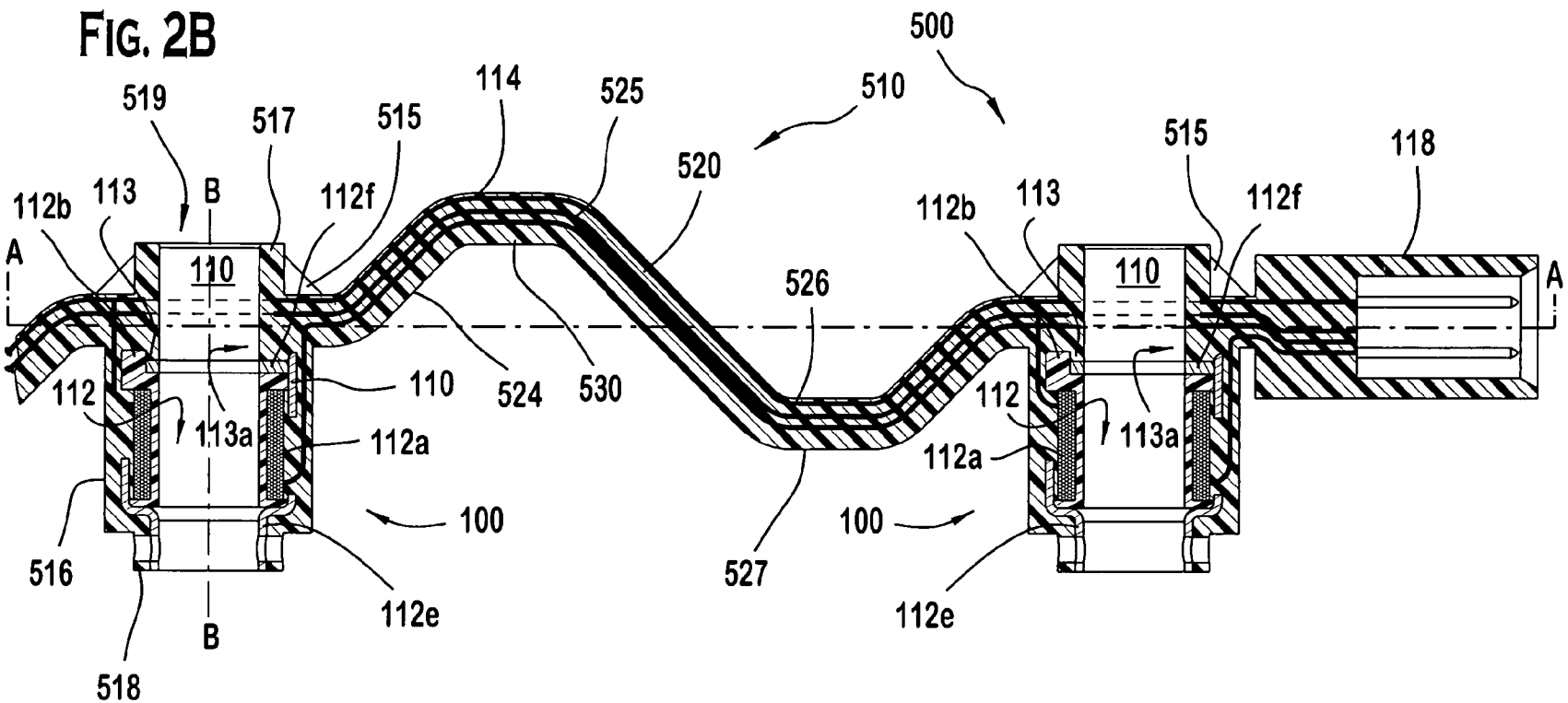
FIG. 2B illustrates a cross-sectional view of the unitary power module of FIG. 2A.

FIGS. 1A–C and 2A–2B illustrate the preferred embodiments. In particular, FIG. 1A illustrates a preferable power module 500 that can be assembled with respective fuel handling units, e.g., valve group subassemblies 200. The power module includes a unitary housing 510 formed from a plurality of first and second housing portions 515, 520 spaced apart along a first axis A—A. Each of the first housing portions 515 is formed to enclose each of a plurality electromagnetic coil subassemblies 100 spaced apart along the first axis A—A. Each of the second housing portions 520 connects the plurality of first housing portions 515 together. The second housing portion includes a connecting wall 525, as shown in FIG. 2B, that can include at least one inflection portion 530 with respect to the longitudinal axis A—A. As used herein, the term "inflection" denotes that the connecting wall 525 can include at least one portion 524 that extends obliquely to the first axis.

As shown in FIG. 2B, each of the first housing portion preferably includes a housing wall 516 extending from a first housing wall end 517 to a second housing wall end 518 along a longitudinal axis B—B. The housing wall can surround the electromagnetic coil 112*a* and the longitudinal axis B—B to define an aperture 519 that receives a valve group subassembly 200. The aperture 519 can be configured so that it extends along the longitudinal axis B—B. In a preferred embodiment, the aperture 519 can include a circular, generally constant cross-sectional area with a radius generally transverse with respect to the longitudinal axis B—B, and the aperture 519 extends from the first housing wall end 517 to the second housing wall end 518 along the longitudinal axis B—B. The second housing portion 520 can be used to locate each of the first housing portions 515 at one of a plurality of desired spacings along the first axis A—A. The second housing portion 520 includes at least one connector wall 525 that encloses electrical conductors 114 for the respective plurality of electromagnetic coil subassemblies 100. In particular, the at least one connector wall 525 can have in a preferred embodiment, at least two generally planar surfaces 526, 527 that are generally parallel to one another so that each of the plurality of first housing portions 515 is spaced apart from one another at a first distance along the first axis A—A. The at least two generally planar surfaces 526, 527 include four generally planar surfaces with two of the four generally planar surfaces generally orthogonal to the other two generally planar surfaces 528, 529 so that the at least one connecting wall 525, in cross-section, define a polygonal cross-section. Although other cross-sections of the at least one connecting wall 525 can be of other cross-sections such as, for example, circular or generally polygonal, a preferred embodiment is generally rectangular.

The first and second generally planar surfaces 526, 527 can be generally parallel and in a mirror-image arrangement so that can be spaced apart at a first distance less than a second distance separating the third and fourth generally planar surfaces 528, 529, which are orthogonal to the first and second surfaces 526, 527. By virtue of this arrangement, the connecting wall permits the first housing portion 515 to rotate and translate with respect to the first axis A—A, i.e., to provide flexibility in the spacing arrangement of the first housing portions. This flexibility of the power module 500 is believed to allow for the ability to compensate for misalignment due to manufacturing tolerances between the various components of the fuel system. Preferably, as shown in FIG. 1A, the at least one connecting wall 525 includes two generally symmetrical connecting walls 532, 534 with respect to the first axis A—A with a slot 536 formed through each of the connecting walls so that one of the first housing portions can rotate about twenty (20) degrees with respect to the first axis A—A, translate about five (5.0) millimeters with respect to the first axis A—A, and the tube outlet 202*b* can translate about (5.0) millimeters with respect to the first axis A—A and pivot about twenty (20) degrees with respect to any axes orthogonal to the first axis A—A. Preferably, the tube outlet 202*b* translates about 0.5 millimeters with respect to the first axis A—A and pivot about two (2.0) degrees with respect to any axes orthogonal to the first axis A—A. The slot 536 preferably can be formed so that the slot 536 extends along the first axis A—A over a linear distance less than the distance between any two adjacent first housing portions 515. The first and second housing portions 515, 520 can be formed from a suitable material such as, for example, polymer or a suitable non-conductive material. In the preferred embodiments, the first and second housing portions 515, 520 are nylon 6—6.

Referring to FIG. 1B, details of a preferred embodiment of the electromagnetic coil subassemblies 100 are shown. Each of the electromagnetic coil subassemblies 100 can be molded as part of the housing so that the electromagnetic coil 112*a* can generally be embedded within the wall 516. Where the coil 112*a* is embedded within the housing 515, any portion of the electromagnetic coil 112*a* is spaced from the longitudinal axis at a distance greater than preferably the cross-sectional area of the aperture 519 (FIG. 2B) about the longitudinal axis. The electromagnetic coil subassembly 100 can include, in a preferred embodiment, coil wire 112*a*, connectors for the coil wire ends 111, a bobbin 112*b* on which the wire of the coil 112*a* is wound, a flux washer 112*f* to facilitate the flow of magnetic flux when the coil is energized, and a coil supporting cup 112*e*. In particular, a suitable coil wire 112*a* such as, for example, copper, aluminum, or steel can be connected to the electrical harness 118 through respective conductive wires 114 disposed within the surface of the unitary power module 500. The electrical harness 118 can be provided for the individual strands of conductive wire (four power strand and a common ground wire) or a single wire with multiplexing capability. As shown in FIG. 1A, the strands of wire 114 can be pre-formed into a desired configuration prior to being overmolded as unitary components of the power module. Preferably, the coil wires 112*a* and conductive wires 114 are copper, the bobbin is nylon 6/6, the coil housing and flux washer are ferromagnetic steel, and the module is nylon 6/6.

The bobbin 112*b* can be disposed within a coil-supporting cup 112*e*, which is magnetically coupled to the flux washer 112*f* disposed at a distal end of the coil-supporting cup 112*e*. The components are assembled and preferably insert molded together with the module to form the unitary power module 500. Preferably, the electromagnetic coil subassembly 100, including electrical connectors 114, can be tested independently of the valve group subassembly 200 after being insert molded as a unitary part of the module. Details of the electromagnetic coil subassembly, including other preferred embodiments, are described and illustrated in U.S. Patent Publication No. 20020047054, entitled "Modular Fuel Injector And Method Of Assembling The Modular Fuel Injector" and published on Apr. 25, 2002, which is hereby incorporated by reference in its entirety.

As shown in FIG. 1A, a fuel injector module can be provided by the attachment of the valve group subassemblies 200 with the power module 500. In particular, the valve group subassembly 200 is disposed in each of the plurality of first housing portions 515 and connected to the first housing portion via a securement 540. The valve group subassembly 200 can include a suitable fuel injection valve and its associated components to meter fuel and which are independently assembled from a magnetic motive source. Referring to FIG. 1C, the valve group subassembly 200 can include an inlet tube assembly 202 extending between a tube inlet 202*a* and a tube outlet 202*b* along a valve group subassembly axis C—C. Preferably, the valve group subassembly 200 includes an exterior tube assembly having a generally constant cross-sectional area along the axis C—C. The inlet tube assembly 202 can be formed as a unitary unit with a pole piece 202*c*. In such preferred embodiment, the unitary tube assembly forms a pole piece 202*c*; the pole piece 202*c* is connected to a first end 202*d* of a non-magnetic shell 202*e*; the non-magnetic shell 202*e* can include a second end 202*f* connected to a valve body 202*g*. The non-magnetic shell 202*e* can be formed from non-magnetic stainless steel, e.g., 300 series stainless steels, or other materials that have similar structural and magnetic properties. Where the tube assembly is formed from more than one unitary piece, the tube assembly preferably includes a tube inlet tube 202 connected to a pole piece 202*c*; the pole piece 202*c* is connected to a first end 202*d* of a non-magnetic shell 202*e*; the non-magnetic shell 202*e* can include a second end 202*f* connected to a valve body 202*g*. The tube inlet 202*a* may include a filter 204 coupled to a preload adjuster 206 or the filter 204 can be mounted in the fuel supply such that only the preload adjuster 206 is mounted in the inlet tube assembly 202 (not shown). The tube inlet 202*a* can also include a flange 203 to provide a stopper mechanism during a top down insertion of the valve group subassembly 200 into the power group subassembly 100.

The valve body 202*g* can contain a seat 208, orifice plate 210, closure assembly 212 and a lift-setting sleeve 214. The seat 208 includes a generally conical seating surface 208*a* disposed about the valve group subassembly axis C—C and a seat orifice 218 co-terminus with the generally conical seating surface 208*a*. The seat 208 can include an orifice plate 210 disposed proximate the seat orifice 218. The closure assembly 212 includes a closure member 220, preferably a spherical shaped member, coupled to an armature 222 via an armature tube 224. The armature 222 can include an internal armature pocket 222*a* to receive a preload spring 226, which is disposed partly in the inlet tube assembly 202 and preloaded by a preload adjuster 206. Extending through the armature 222 and armature tube 224 is a through-bore 228 with apertures 230 formed on the surface of the armature tube 224 to permit fuel to flow from the inlet tube towards the seat 208. The apertures 230, which can be of any shape, are preferably non-circular, e.g., axially elongated, to facilitate the passage of gas bubbles. For example, in the case of a separate intermediate portion or tube 224 that is formed by rolling a sheet substantially into a tube, the apertures 230 can be an axially extending slit defined between non-abutting edges of the rolled sheet. However, the apertures 230, in addition to the slit, would preferably include openings extending through the sheet. The apertures 230 provide fluid communication between the at least one through-bore 228 and the interior of the valve body 202*g*. Thus, in the open configuration, fuel can be communicated from the through-bore 228, through the apertures 230 and the interior of the valve body 202*g*, around the closure member 220, through the opening 208 of the seat and through metering orifices formed through an orifice plate 210 into the engine (not shown).

The armature 222 is disposed in the tube assembly 202 such that a ferromagnetic portion 222*b* can be spaced through a working gap in a closed position of the armature and contiguous to the pole piece 202*c* in an open position of the armature 222. The spherical valve element 220 is moveable with respect to the seat 208 and its generally conical sealing surface 208*a*. The closure element 220 is movable between a closed configuration (FIG. 1B), and an open configuration (not shown). In the closed configuration, the closure member 220 contiguously engages the sealing surface 208*a* to prevent fluid fuel flow through the seat orifice 218. In the open configuration, the closure member 220 is spaced from the seat 208 to permit fuel flow through the opening 218.

The intermediate portion or armature tube 224 can be fabricated by various techniques, for example, a plate can be rolled and its seams welded or a blank can be deep-drawn to form a seamless tube. The intermediate portion 224 is preferable due to its ability to reduce magnetic flux leakage from the magnetic circuit formed by the assembly of a fuel injector from the subassemblies 100, 200. This ability arises because the armature tube 224 can be non-magnetic, thereby magnetically decoupling the magnetic portion or armature 222 from the ferro-magnetic closure member 220. Because the ferro-magnetic closure member 220 is decoupled from the ferro-magnetic or armature 222 via the preferably non-magnetic armature tube 224, flux leakage is reduced, and thereby the magnetic decoupling is believed to improve the efficiency of the magnetic circuit.

Surface treatments can be applied to at least one of the end portions of the armature 222 or the pole piece 202*c* to improve the armature's response, reduce wear on the impact surfaces and variations in the working air gap between the respective impacting end portions of the armature 222 and pole piece 202*c*. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening.

In the case of a spherical valve element providing the closure member 220, the spherical valve element can be connected to the closure assembly 212 at a location that is less than the diameter of the spherical valve element 220. Such a connection could be on the side of the spherical valve element 220 that is opposite contiguous contact with the seat 208. A lower armature guide 232 can be disposed in the tube assembly, proximate the seat 208, and would slidingly engage the diameter of the spherical valve element. The lower armature guide 232 can facilitate alignment of the closure assembly 212 along the valve axis C—C.

The valve group subassembly 200, as described above, can be calibrated and tested (i.e., pre-calibrated) prior to its installation in the power module 500. Details of the valve group subassembly 200, including valve subassemblies 200*a* and 200*b*, including other preferred embodiments, are described and illustrated in U.S. Patent Publication No. 20020047054, entitled "Modular Fuel Injector And Method Of Assembling The Modular Fuel Injector" and published on Apr. 25, 2002, which is hereby incorporated by reference in its entirety.

The valve group subassembly 200 can be rotated angularly about the valve assembly axis C—C so that a suitable spray pattern or spray targeting can be generated downstream of the respective air outlets 104. Index markings visible through air outlet 104 can be formed on the surface of the valve group subassembly 200 and on the exterior surface of the chamber 110 for adjustment of the angular position of the valve group subassembly 200 relative to the chamber 110. When the angular and axial positions of the valve group subassembly 200 have reached the respective desired positions in the chamber 110, a suitable technique such as crimping, welding or bonding can be used to secure the valve group subassembly 200 to the chamber 110. Where the separate power subassemblies 112' are used instead of the unitary power subassemblies 112. Thereafter, the assembled power module 500 can be assembled to the engine 600 and a fuel supply can be connected to the inlet of each valve group subassembly 200. Due to possible variation in engineering tolerances for the spacing interval between each of the fuel rail cups 625, the inlet ends 202*a* of the valve group subassemblies 200 may not fit into the respective fuel rail cups 650. In such circumstance, by virtue of the flexibility of the connecting portion 525 between the first housing portions 515, each inlet end 202*a* of the valve group subassembly 200 can be translated along the first axis A—A; rotated about the first axis A—A or the second axis orthogonal to the first axis A—A so that the inlet end 202*a* can be fitted within the fuel rail cup 625. Similarly, due to potential variation in engineering tolerances for the spacing interval between each of the fuel injection ports 650, the outlet ends 202*b* of the valve group subassembly 200 may not fit into the respective fuel injection ports 650. In such circumstance, by virtue of the flexibility of the connecting portion between the first housing portions 515, each inlet end 202*a* of the valve group subassembly 200 can be translated along the first axis A—A; rotated about the first axis A—A or the second axis orthogonal to the first axis A—A so that the outlet end 202*b* of each valve group subassembly 200 can be fitted within the fuel injection port 650. That is, the preferred embodiments permit compensation for misalignments due to cumulative tolerance of components, during installation, or due to thermal expansions between (a) the outlet 202*b* of each valve group subassembly 200 with each fuel injection port 650 so that each outlet end 202*b* is disposed within each fuel injection port 650 to prevent leaks therefrom, or (b) the inlet end 202*a* of each valve group subassembly 200 with each fuel rail cup 625 so that each inlet end 202*a* is disposed within each fuel rail cup 625 to prevent leaks therefrom.

Although the fuel injection module 500 has been described as being mounted between a fuel rail 625 and respective fuel injection ports 650, the power module of the preferred embodiments can be assembled as part of an integrated air-fuel manifold, as shown and described in U.S. patent application Ser. No. 10/402,969 entitled "Injector Valve for Integrated Air-Fuel Module," filed on Apr. 1, 2003, which is incorporated by reference in this application.

In operation, an electromagnetic coil 112*a* of the power module 500 can be energized via the electrical connector 118 and conductive wire 114, thereby generating magnetic flux in a magnetic circuit. The magnetic flux moves the closure assembly 212 towards the pole piece 202*c*, i.e., closing the working air gap. This movement of the closure assembly 212 separates the closure member 222 from the seat 208 and allows fuel to flow from the fuel rail cup 650, through the inlet tube 202*a*, the through-bore 228, the apertures 230 and the valve body 202*g*, between the seat 208 and the closure member 220, through the opening 218, and finally through the orifice plate 210 into the internal combustion engine (not shown). When the electromagnetic coil 112*a* is de-energized, the closure assembly 212 is moved by the bias of the resilient member 226 to contiguously engage the closure member 220 with the seat 208, and thereby prevent fuel flow to the air supply passage.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel injector module comprising:

a housing having a plurality of first and second housing portions spaced apart along a first axis, each of the first housing portions being formed to enclose each of a plurality electromagnetic coil subassemblies spaced apart along the first axis, each of the second housing portions connecting the plurality of first housing portions along the first axis, each of the second housing portions including a wall with at least one inflection portion with respect to the first axis, each of the walls including a slot disposed between each of the plurality of first housing portions; and a valve group subassembly disposed in each of the plurality of first housing portions and connected to the first housing portion via a securement.

2. The fuel injector module of claim 1, wherein the securement comprises a first connecting portion formed on the first housing portion and a second connecting portion formed on the valve group subassembly.

3. The fuel injector module of claim 2, wherein the valve group subassembly comprise a tube assembly having a generally constant cross-sectional area extending between inlet and outlet ends of the tube assembly.

4. The fuel injector module of claim 3, the tube assembly comprises:

a pole piece proximate the inlet end;

a seat proximate the outlet end and defining an opening;

an armature disposed between the inlet end and outlet end, the armature being spaced at a working gap form the pole piece in one position of the armature;

a member biasing the armature along an axis of the tube assembly towards the seat; and a closure member to the armature, the closure member being movable along the axis between a first position occluding fuel flow through the outlet end and a second position permitting fuel flow through the outlet end.

5. The fuel injector module of claim 4, wherein the tube assembly further comprises:

an inlet tube proximate the inlet connected to a first shell end of a non-magnetic shell and a valve body proximate the outlet end connected to a second shell end of the non-magnetic shell;

a filter located within the inlet tube proximate the pole piece, the filter engaging the member and adjusting a biasing force of the member on the armature, the filter including a conical end projecting towards the seat and spaced from the member; and a lift setting sleeve contiguous to the valve body and the seat so that the lift sleeve defines a working gap between the pole piece and the armature.

6. The fuel injector module of claim 4, wherein the valve group subassembly comprises a pre-calibrated valve group subassembly calibrated to at least one of a preset flow rate and working gap prior to being located in the first housing portion of the power module.

7. The fuel injector module of claim 6, wherein each of the first housing portions comprises:

a wall extending from a first housing wall end to a second housing wall end along a longitudinal axis, the wall surrounding the longitudinal axis to define and aperture that receives the valve group subassembly;

an electromagnetic coil disposed in the wall to surround the armature and pole piece of the valve group subassembly, the electromagnetic coil having a coil wire formed over a bobbin, the bobbin being supported by a coil supporting cup being magnetically coupled to a flux washer surrounding the aperture; and a common electrical harness disposed in the housing, the common electrical harness electrically connecting the coil wire to an electrical connector formed as a unitary unit with the fuel injector module.

8. A power module for a fuel injection unit comprising:

a housing having a plurality of first and second housing portions spaced apart along a first axis, each of the first housing portions being formed to enclose each of a plurality electromagnetic coil subassemblies spaced apart along the first axis, each of the second housing portions connecting the plurality of first housing portions along the first axis, each of the second housing portions including a wall with at least one inflection portion with respect to the first axis, each of the walls including a slot disposed between each of the plurality of first housing portions.

9. The power module of claim 8, wherein each of the first housing portion comprises a wall extending from a first housing wall end to a second housing wall end along a longitudinal axis, the wall surrounding the electromagnetic coil and the longitudinal axis to define an aperture that receives a valve group subassembly, the aperture extending along the longitudinal axis.

10. The power module of claim 9, wherein the aperture comprises an aperture having a generally constant cross-sectional area along the longitudinal axis from the first housing wall end to the second housing wall end.

11. The power module of claim 10, wherein the aperture comprises a circular cross-sectional area having a first radius extending generally transverse to the longitudinal axis.

12. The power module of claim 11, wherein each of the electromagnetic coil subassemblies comprises an electromagnetic coil disposed in the wall to surround the longitudinal axis so that the coil surrounds the aperture at a second radius greater than the first radius, the electromagnetic coil having a coil wire formed over a bobbin, the bobbin being supported by a coil supporting cup being magnetically coupled to a flux washer surrounding the aperture.

13. The power module of claim 12, wherein the second housing portion comprises at least one wall enclosing electrical conductors for respective plurality of electromagnetic coil subassemblies.

14. The power module of claim 13, wherein the at least one wall comprises first, second, third, and fourth surfaces generally parallel to each other so that each of the plurality of first housing portions is spaced apart from adjacent first housing portion at a first distance along the first axis.

15. The power module of claim 14, wherein first and second surfaces of the at least one wall comprise generally planar surfaces spaced apart over a width greater than a thickness between the third and fourth surfaces so that each of the first housing portions rotates about the first axis over a magnitude of about 3 degrees and about a second axis orthogonal to the first axis over a magnitude of about 2 degrees.

16. The power module of claim 14, wherein the slot disposed between each of the plurality of first housing portions allows each of the plurality of first housing portions to translate relative to adjacent first housing portions along the first axis of about 1 millimeter.

17. The power module of claim 15, wherein the slot extends along the first axis at a second distance less than the first distance.

* * * * *